US005347942A

United States Patent [19]

Thomas

[11] Patent Number: 5,347,942

[45] Date of Patent: Sep. 20, 1994

[54] THREAD GUIDE AND RETAINING DEVICE

[76] Inventor: Charles D. Thomas, 7545 Butler Hills Dr., Salt Lake City, Utah 84121

[21] Appl. No.: 34,074

[22] Filed: Mar. 22, 1993

[51] Int. Cl.[5] ..... B65H 57/00

[52] U.S. Cl. ..... 112/302; 223/106

[58] Field of Search ..... 112/262.1, 302, 80.7, 112/163; 28/208, 212; 139/97; 242/131, 131.1, 139, 140, 130; 223/106; 206/574, 392, 393

[56] References Cited

U.S. PATENT DOCUMENTS

| | | | |
|---|---|---|---|
| 820,596 | 8/1893 | Norwood | 223/106 X |
| 1,822,765 | 10/1930 | Dickey . | |
| 2,497,359 | 8/1947 | Isabelle, Sr. . | |
| 2,625,345 | 10/1949 | Palma . | |
| 3,126,695 | 10/1962 | McGill . | |
| 3,706,402 | 12/1972 | O'Leary | 223/106 |
| 3,875,883 | 4/1975 | Eberwein et al. . | |
| 4,078,505 | 3/1978 | Fitton . | |
| 4,393,793 | 7/1983 | Beasley . | |

FOREIGN PATENT DOCUMENTS

| | | | |
|---|---|---|---|
| 660101 | 1/1964 | Italy | 112/302 |
| 63-57092 | 3/1988 | Japan | 112/302 |
| 22040 | of 1913 | United Kingdom | 242/125 |
| 534006 | 2/1941 | United Kingdom | 112/253 |
| 784472 | 10/1957 | United Kingdom | 112/302 |

*Primary Examiner*—Clifford D. Crowder
*Assistant Examiner*—Paul C. Lewis
*Attorney, Agent, or Firm*—Thorpe, North & Western

[57] ABSTRACT

A thread feeding device for use with multiple needles of a sewing machine wherein the thread feeding device includes an array of guide channels which have first openings at one end for receiving threads from supply spools and second openings at the remaining end for dispensing the threads to a sewing machine. A support plate provides a base for attachment of the guide channels above the sewing machine with the second openings oriented toward the user. The thread feeding device includes a strip of hook and loop fasteners such as VELCRO TM, spring element or other member for retaining ends of the threads exiting the second opening such that the threads remain accessible for ready grasp of the user. Also disclosed is a method of feeding thread to a sewing machine, including the step of affixing loose ends of the threads at the VELCRO TM, spring member or other retaining means for holding the loose end against movement and preventing the threads from sliding back through the guide channels, even during transport of the thread and spool assembly.

6 Claims, 4 Drawing Sheets

THREAD GUIDE AND RETAINING DEVICE

BACKGROUND OF THE INVENTION

1. Field of Invention

The present invention relates to devices for supplying multiple threads to a sewing machine to enable a user to make selections of thread choice for use in a particular sewing project. More particularly, this invention pertains to devices for maintaining the multiple threads in an orderly array, with ends of the threads collectively displayed at a convenient access location near the user.

2. Prior Art

Commercial sewing operations (including embroidery, monogramming, applique) often involve the use of multiple operating needles which are collectively sewing threads of various colors and styles onto a work piece. Various stages of sewing will require changing threads to facilitate a new pattern or new work piece. Typical methods and machines require the user to replace one or more threads with threads of different colors. Often this procedure requires the user to leave his seat to retrieve the new threads from their spools and place them in thread guides for proper alignment for feeding into the sewing machine. Accordingly, changes in work piece or pattern generally result in down time that can represent a very costly interruption in production.

The need for having a plurality of spools positioned in such a way as to allow the user of the sewing machine to change threads as quickly as possible is apparent from prior art patents. For example, patents 1,822,765 and 2,625,345 disclose a plurality of thread spools positioned directly on the sewing machine itself. Each thread is displayed for the user so that he can quickly change the thread in the sewing machine. These inventions, however, are limited to the number of thread spools that can be positioned on the sewing machine by the size of the sewing machine. Secondly, all of the thread spools correspond to a particular needle and the use of multiple needles with these inventions is not likely under the definitions of each patent.

Another problem that has existed with the use of multiple thread spools is that the different threads have a tendency to entangle with each other. One of many ideas to avoid this problem has been the use of guide tubes to separate the various threads. For example, patents 3875883, 4078505, and 4393793 disclose the use of these guide tubes being used in cooperation with a plurality of thread spools. The guide tubes lead each thread into a corresponding needle, thereby avoiding entanglement. These inventions, however, are limited to industrial applications because they all are to be used in cooperation with a tufting machine. Each thread has a corresponding needle within the tufting machine and there is no suggestion of the idea of each thread being displayed to the user.

The use of multiple spools of thread has been commonly practiced in the sewing industry by supporting an array of spools supported on a platform. The selection of different threads, however, has typically involved the changing of the spools, rather than the use of a large array of spools available for ready access. Although such an array has been provided, devices for maintaining the ends of the unused threads readily available for interchange have been limited.

For example, U.S. Pat. No. 2,497,359 discloses a device that displays multiple threads to a user by using a rack system that holds a multiple number of thread spools. This rack is then fastened to a sewing table and each individual thread is loosely threaded through an eye within a closed hook suspended immediately above the spool. Although this invention displays thread to the user, there exists a problem with maintaining the threads in these hooks. The thread can easily fall back through the hook and become entangled with other threads because there is no fastening device that grasps the end of the thread. Secondly, the rack is not mobile because it is fastened onto the sewing table. Lastly, the number of thread spools is inhibited by the size of the rack. Although it may be possible to make a larger rack, positioning many spools in close proximity makes the adjacent threads vulnerable to inadvertent contact by the users hand, dislodging the threads from their suspended hooks.

OBJECTS AND SUMMARY OF THE INVENTION

It is an object of the present invention to provide a thread guide system which organizes multiple threads being fed to a sewing machine to keep the threads from becoming twisted, entangled and displaced from an accessible location to the user.

Another object of this invention is to provide a thread guide system that includes a retaining structure proximate to the user which holds the ends of unused threads ready for quick replacement of other threads in previous use.

A further object of this invention is to provide such a thread guide system which is mobile and capable of being moved from one sewing machine to another without dislodging any of the suspended threads.

These and other objects are realized in a thread feeding device for use with multiple needles of a sewing machine which includes an array of guide channels having first openings at one end for receiving threads from supply spools, and second openings at opposing ends for dispensing the threads for feeding to the sewing machine. Support structure is coupled to the array of guide channels for positioning the guide channels above the sewing machines with the second openings oriented toward a user. Retaining means are positioned at the second openings to receive threads from the array of guide channels when not in use and to retain ends of the threads in an accessible condition for ready grasp of the user.

Also disclosed is a method for maintaining a plurality of ends of threads supplied from spools in an orderly manner for selection by a user to facilitate quick changes in threads applied to a sewing machine. This method is represented by the steps of a) positioning spools of thread on spool supports to provide a plurality of thread selections; b) feeding thread from the spools through an array of guide channels which dispense the threads through forward openings of the guide channels; and c) affixing loose ends of the threads from the forward openings at retaining means which hold the loose ends against movement and prevent the threads from sliding back through the guide channels, while at the same time allowing the user to quickly and readily grasp the loose ends and feed the threads onto a sewing machine.

Other objects and features of the present invention will be apparent to those skilled in the art, based on the following detailed description of a preferred embodiment, taken in combination with the accompanying drawings.

DETAILED DESCRIPTION OF PREFERRED EMBODIMENT

Figure 1:
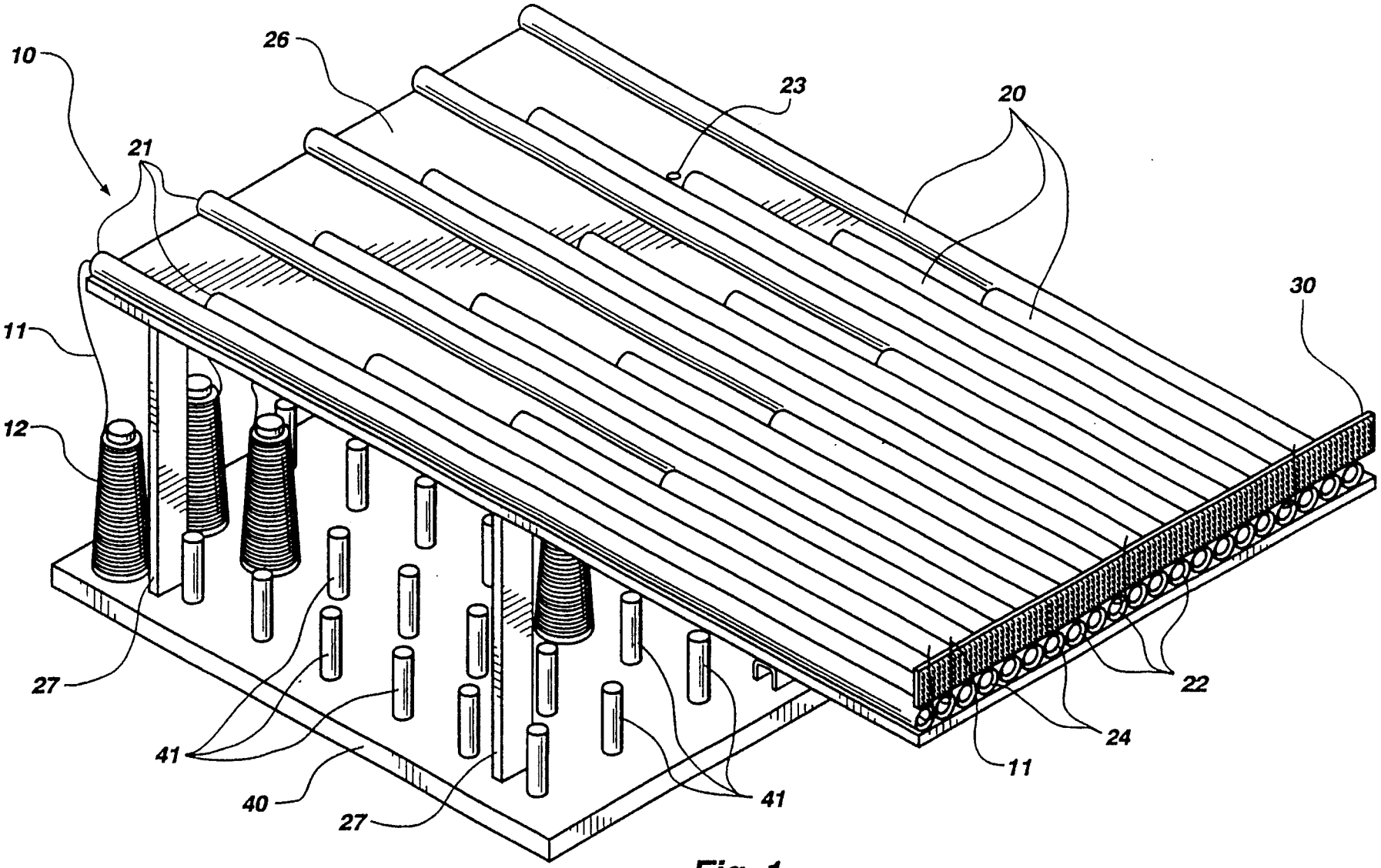
FIG. 1 shows a perspective, elevational view of a thread feeding device configured in accordance with the present invention.
Figure 2:
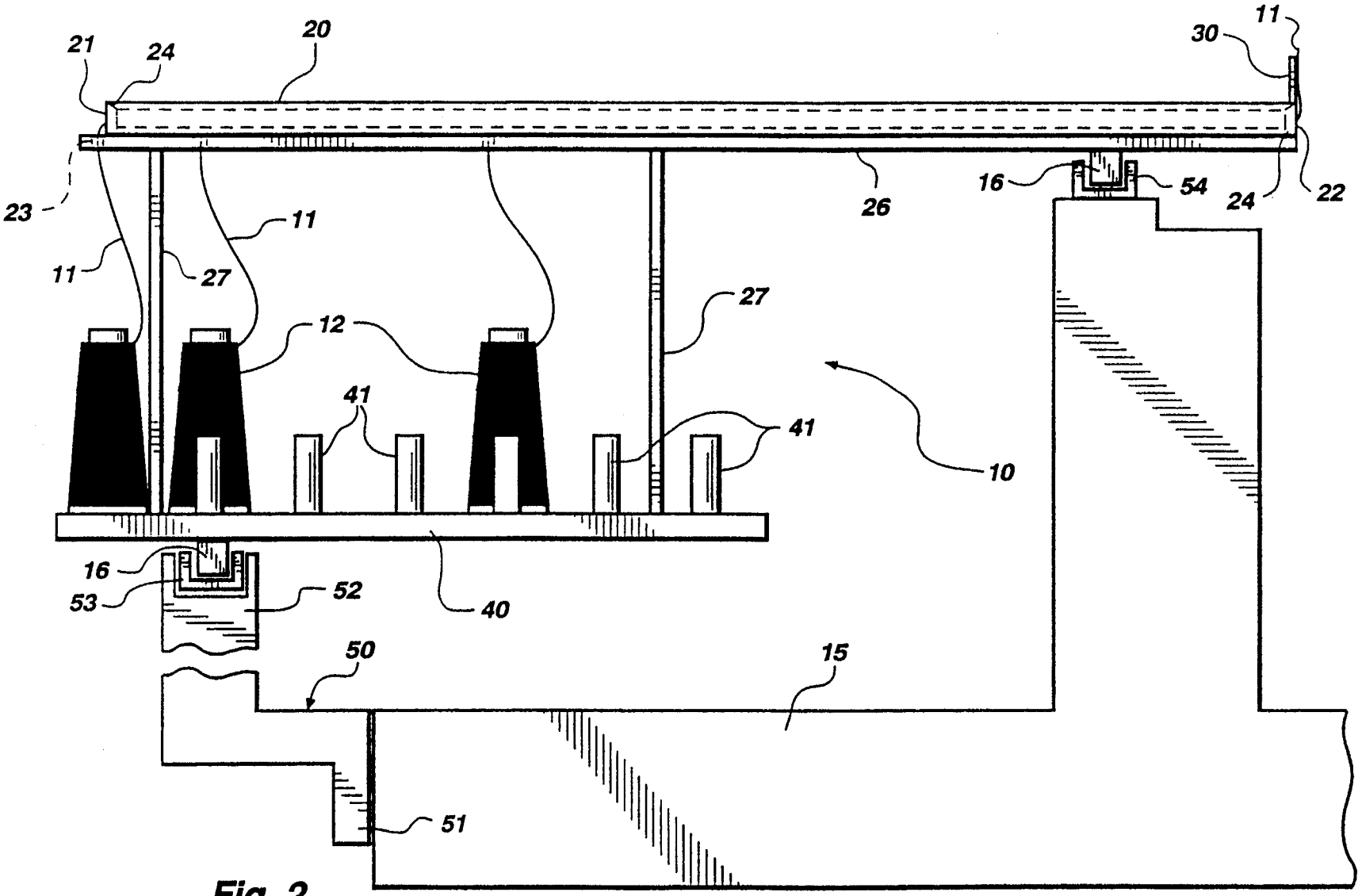
FIG. 2 illustrates a side, plan view of the device shown in FIG. 1.
Figure 3:
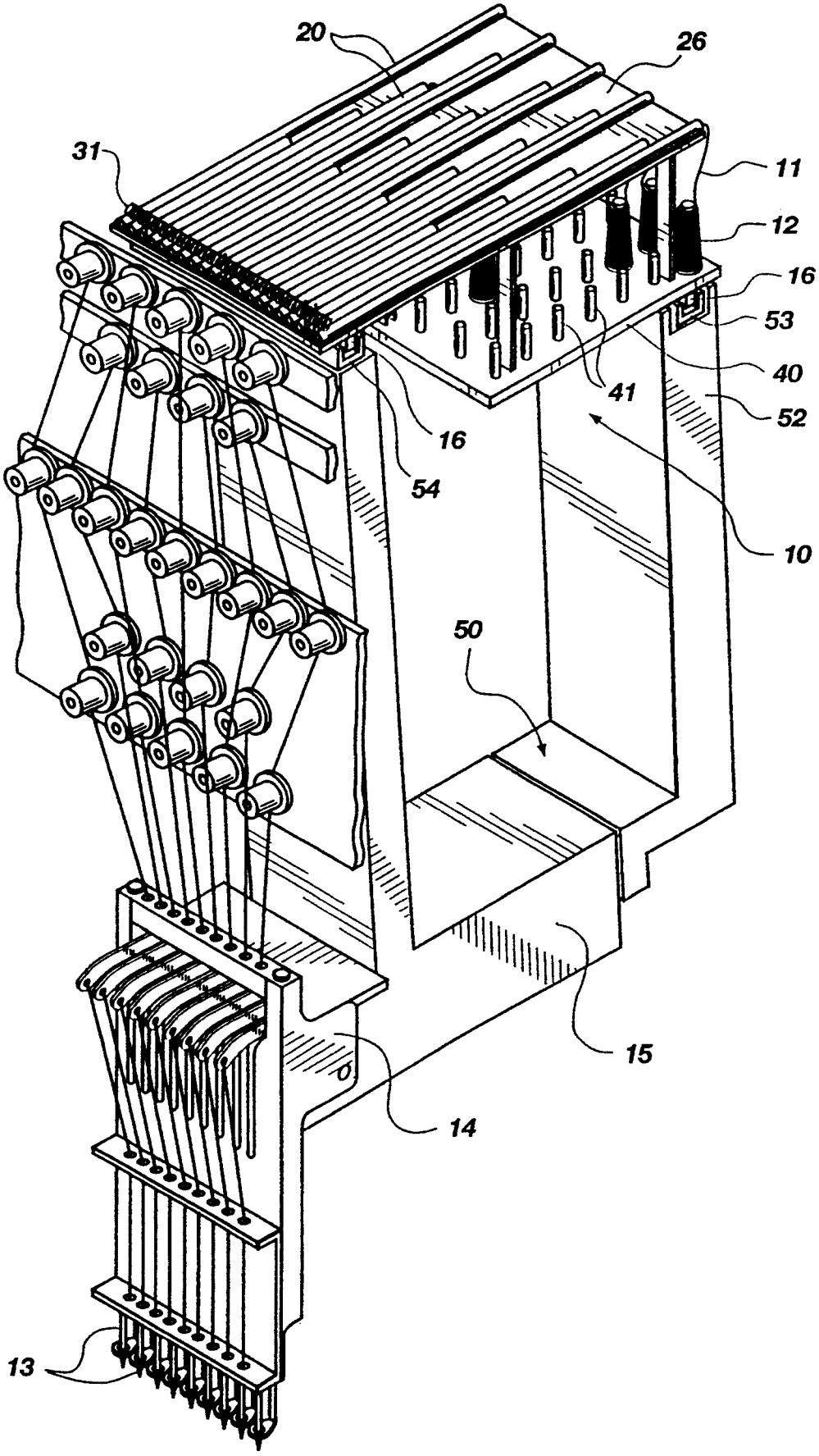
FIG. 3 depicts an alternate form of retaining means mounted on the thread feeding device.

Referring now to the drawings:

A thread feeding device 10 is shown generally in association with thread 11 supplied from spools 12 to multiple needles 13 of a sewing machine 14. This device may be used with a variety of threads 11, such as conventional thread, yarn, fiber, etc. which may be supplied to a sewing machine having a multiple array of needles for processing threads of difference kind or color.

The threads are maintained in an orderly array by passage through an array of guide channels or tubes 20. These channels prevent the threads from intermingling and becoming tangled. Thus, the threads are maintained in a knot-free condition with unhampered mobility to ensure a free and continuous thread run to each of the sewing machine needles.

Each guide channel has a first opening 21 at one end for receiving threads from the supply spools, and a second opening 22 at an opposing end for dispensing the threads for feeding to the sewing machine. Threads can be inserted directly into these ends when tubular structure is used, or across the top of the channels when an open channel embodiment is employed. The first and second openings 21 and 22 of the guide channels are shown with a bevelled interior edge 24 to reduce drag on the threads moving through the channels. This bevelled edge also prevents unnecessary wear on threads drawn across this surface. Guide holes 23 are provided near openings 21, directly above the supply spools 12. These guide holes 23 may also be bevelled to further reduce drag.

The guide channels are attached to a support means 26 for positioning the guide channels above the sewing machines with the second openings oriented toward a user. The illustrated support means 26 comprises a support plate of planar configuration for supporting the guide channels in parallel relationship. Vertical columns 27 are attached to the support plate for positioning the support plate and guide channels in a substantial horizontal or slightly inclined orientation above the sewing machine.

The length of the guide channels and support plate will depend upon the depth of the sewing machine which the device is to supply. The ideal length will place the second ends of the channels forward of the machine and above the operating needles. The height will be such that the user may reach from a convenient position to grasp and interchange threads with respect to any of the needles. In addition, the guide channels are in a linear array and at a common plane in the horizontal orientation to facilitate equal access to either side of the array from a seated or other convenient position. It will be apparent to one skilled in the art that other configurations could likewise be implemented including stacked layers of channels or tubes, or tubes in a vertical array along one side of the sewing machine.

A significant feature of the present invention includes a retaining means 30 positioned at the second openings to receive threads from the array of guide channels when not in use and to retain ends of the threads in an accessible condition for ready grasp of the user. This ensures that the threads do not inadvertently slide back through the tubes or channels and lose their suspended or fixed position in front of the user. In contrast to the mere dangling of a thread end through a loop or over the second end of the channel, the subject retaining means effectively grasps the thread ends to hold them in place until needed.

Figure 4:
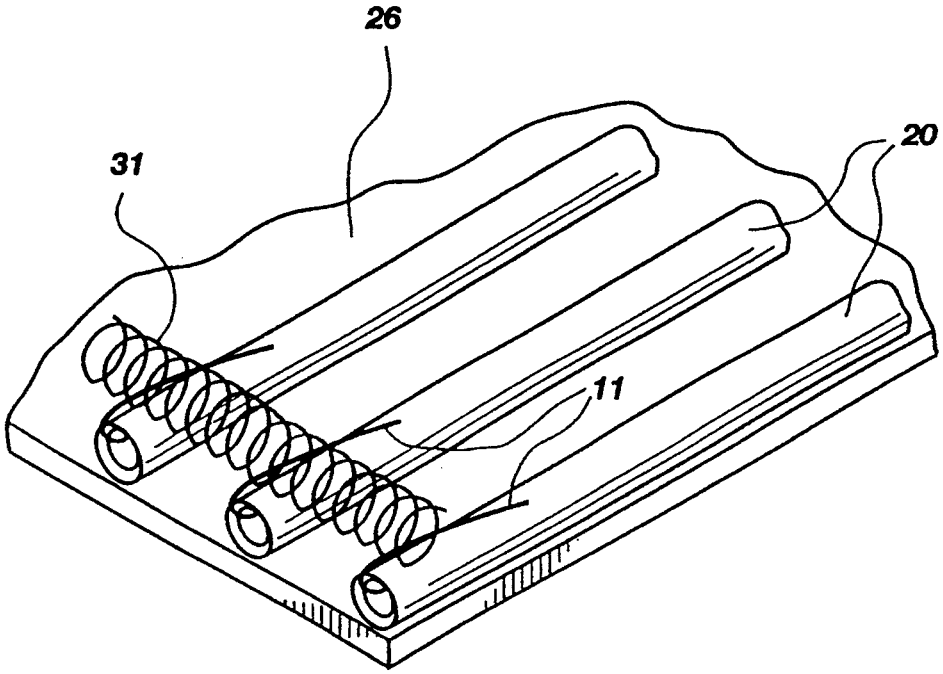
FIG. 4 illustrates a perspective, close-up view of the alternate form of retaining means of FIG. 3.

The retaining means 30 of FIG. 1 comprises a strip of material to which the threads will adhere. This strip of material may comprise felt, hook and loop fasteners such as VELCRO TM, or any other material which releasable tangles or adheres with the thread ends. This strip may extend partially or fully along the array of channels, depending upon the proximity of adjacent channels and the capacity of the material to maintain the thread ends in separated fashion. In contrast, the retaining means 31 comprises a plurality of spring elements with multiple windings for receiving threads within the multiple windings. Such springs may be continuously extended or spaced along the array of second ends, enabling several threads to be held at various spring locations. As shown most clearly in FIG. 4, a user may simple pass a thread 11 between two of the coils of the spring element 31, the pressure of which holds the thread 11 in position. Other structures which accomplish the similar purpose of retaining the loose threads securely at the second ends of the channels or tubes will be apparent to those familiar with the characteristics of threads and suitable materials.

Various arrangements of thread supply spools and systems are envisioned. The figures illustrate a preferred configuration comprising a base plate 40 which includes a plurality of spool supports 41 for positioning supply spools 12. These spools are shown in vertical orientation, but could be in any position which provides a convenient location for feeding threads to the first end of the guide channels. The combined support means couples the spool supports to the base plate to form an integral unit which can be transported between different locations without disturbing thread supply through the guide channels or displacing retained threads from the retaining means. This portability offers numerous advantages when a whole exchange of thread types must be made on a single machine. In this ultimate need for change, a new integral unit can be brought in place with no loss of retained thread ends ready for future use.

The present thread feeding device 10 is mounted to the sewing machine 14 by means of a support brace 50. This brace is attached at its lower end 51 to an appropriate frame portion 15 of the sewing machine. Within the upper end 52 is nested in an open channel 53 for receiving a support bar 16 rigidly attached to the base plate 40, in order to facilitate rapid placement and/or removal of the thread feeding device 10 from the sewing machine 14. A forward channel 54 is coupled below the support plate 26 and nests a support bar 16 therein which is rigidly attached to a top, forward portion of the thread feeding device 10. The combination of open channels 53 and 54 enable a user to position the thread feeding device quickly over the sewing machine in a stable configuration. Similarly, the threaded feeding device can be removed by simply lifting up on the device and raising it free from the open channels 53 and 54. This is a very important feature in view of the frequent need for servicing access to the sewing machine or substitution of a new array of spools 12.

A plurality of thread supply spools 12 are positioned below the guide tubes in such a way as to allow the thread from a specific thread supply spool to be placed into the first opening of the corresponding guide tube 21. The positioning of the supply spools 12 minimizes the possibility of entanglement of the threads. The thread is then fed through the guide tube 20 and out through the second opening 22 of the guide tube and then attached to the retaining means 30 which is positioned above or near the second opening 22 of the guide tube 20. The guide tubes are positioned in an array which will allow a variety of threads to be orderly displayed on the retaining means 30 for easy access to the user of the sewing machine.

The described structure enables practice of an improved method for maintaining a plurality of ends of threads supplied from spools in an orderly manner for selection by a user to facilitate quick changes in threads applied to a sewing machine. This method begins with the step of positioning spools of thread on spool supports to provide a plurality of thread selections. The next steps involve feeding thread from the spools through an array of guide channels which dispense the threads through forward openings of the guide channels and affixing loose ends of the threads from the forward openings at retaining means which hold the loose ends against movement and prevent the threads from sliding back through the guide channels, while at the same time allowing the user to quickly and readily grasp the loose ends and feed the threads onto a sewing machine.

These improved methods allow an operator at the sewing machine to rapidly make changes of thread by either selecting choices of thread from the array of spools in direct proximity at the retaining means, or by quickly changing to another array of spools to obtain a total new selection. Down time is minimized and the comfort of the operator is enhanced. The subject device and method add minimal cost to production, but can significantly reduce labor costs.

It will be apparent to those skilled in the art that the specific elements of the disclosed devices are merely exemplary, and are not intended to be limiting with respect to the identification of the invention, as set forth in the following claims.

I claim:

1. A thread feeding device for use with a sewing machine, said device comprising:

an array of guide channels having first openings at one end for receiving threads from rows of supply spools, and second openings at opposing ends for dispensing the threads for feeding to the sewing machine, said opposing ends of said guide channels facing in substantially the same direction to thereby cause said second openings to be positioned in substantial adjacent relation in front of the spools;

support means coupled to the array of guide channels for positioning the guide channels above the sewing machines with the second openings oriented toward a user; and retaining means positioned in close, substantially equivalent proximity to each of the second openings to receive threads from the array of guide channels when not in use and to thereby retain the dispensed portions of the threads in spatial isolation from each other and in substantial adjacent relation in an accessible condition for ready grasp of the user when in a seated position;

wherein the support means comprises a support plate for supporting the array of guide channels in parallel relationship;

wherein the support means further comprises vertical positioning means for positioning the support plate and guide channels in a substantial horizontal orientation above the sewing machine;

wherein the guide channels are in a linear array and common plane in the horizontal orientation; and further comprising a base plate which includes a plurality of spool supports for positioning supply spools in a convenient location for feeding threads to the first end of the guide channels, said support means being coupled to the base plate to form an integral unit which can be transported between different locations without disturbing thread supply through the guide channels or displacing retained threads from the retaining means.

2. A device as defined in claim 1, wherein the retaining means comprises a strip of material to which the threads will adhere, said strip of material extending along the array of channels at the second openings.

3. A device as defined in claim 1, wherein the retaining means comprises a plurality of spring elements with multiple windings for receiving threads within the multiple windings.

4. A device as defined in claim 1, wherein the first and second openings of the guide channels are bevelled to reduce drag on the threads moving through the channels.

5. A device as defined in claim 1, further comprising a plurality of spools of thread which are positioned below the first ends of the guide channels, and including threads extending (i) from the spools to the first ends, (ii) through the guide channels, and (iii) through the second openings, a plurality of said threads having loose ends retained at the retaining means to provide ready access for the user.

6. A device as defined in claim 1 further comprising a support brace having a first end configured for attachment to the thread feeding device and a second end adapted for attachment to the sewing machine.

* * * * *